United States Patent [19]

Morris

[11] Patent Number: 4,966,370

[45] Date of Patent: Oct. 30, 1990

[54] GOLFER'S PUTTING PRACTICE DEVICE

[75] Inventor: David Morris, Chattanooga, Tenn.

[73] Assignee: Habitat International, Inc., Rossville, Ga.

[21] Appl. No.: 468,139

[22] Filed: Jan. 22, 1990

[51] Int. Cl.[5] ..... A63B 69/36; A63B 67/02

[52] U.S. Cl. ..... 273/176 F; 273/178 R; 273/127 B

[58] Field of Search ..... 273/176 F, 176 FA, 176 FB, 273/177 R, 177 A, 177 B, 178 R, 178 A, 178 B, 179 R, 180, 127 R, 127 B

[56] References Cited

U.S. PATENT DOCUMENTS

| | | | |
|---|---|---|---|
| 1,544,380 | 6/1925 | Edmonston | 273/178 R |
| 1,939,142 | 12/1933 | Seymour | 273/177 A |
| 2,025,183 | 12/1935 | Stayton et al. | 273/177 R |
| 3,138,387 | 6/1964 | Michel et al. | 273/178 B |
| 3,342,495 | 9/1967 | Wasley | 273/180 |
| 3,464,704 | 9/1969 | Nelson | 273/180 |
| 4,634,130 | 1/1987 | Simjian | 273/26 |

*Primary Examiner*—George J. Marlo
*Attorney, Agent, or Firm*—Larson and Taylor

[57] ABSTRACT

A golf ball retainer is disclosed for use with a practice putting carpet, the two forming a golf practice putting device. The putting carpet is conventional and includes a raised end that contains an orifice which serves as a golf cup or target. The ball retainer in a presently preferred embodiment is molded from a vinyl plastic in one integral piece that has a substantially E-shape in cross section. The ball retainer is comprised of a first, grasping section that includes a pair of hooks on the ends of spaced apart arms. The hooks can removeably grasp an edge of the carpet. A second, catcher section of the ball retainer is also comprised of two spaced apart arms, one of which is used by the first section. The catcher section can retainably receive a ball rolling into contact between its arms.

20 Claims, 1 Drawing Sheet

GOLFER'S PUTTING PRACTICE DEVICE

FIELD OF THE INVENTION

The present invention relates in general to a golf practice putting device, and more specifically relates to a golf ball retainer for use with a conventional golf practice putting green to catch a golf ball that has missed the cup and would otherwise roll over the edge of the carpet.

BACKGROUND OF THE INVENTION

Golf practice putting devices are known, and numerous patents disclosing a plethora of devices are well classified in the Patent and Trademark Office in Search Class 273. In addition, there are numerous devices on the market which simulate a golf putting green, such as commercially available carpets sold by Habitat International, Inc. Such carpets usually comprise a top surface simulative of closely cropped grass, sometimes described as indoor/outdoor carpet, mounted on a resilient backing. Such carpet includes one end that is raised as a result of a wedge-shaped piece of sponge rubber providing a thickness at that end of the carpet of over an inch and a half. In this thickened end, an orifice is provided which extends completely through the carpet and resilient backing. One disadvantage of such carpet is that if the golfer has set up the practice putting carpet in an office and misses the hole, the ball can roll off the thickened end, and possibly be lost or cause other problems.

Although the prior art discloses devices for retaining a golf ball on a putting surface, or disclose golf targets in which the golf ball is retained should the target be contacted, there is no known prior art that discloses a device that is attachable to a putting carpet and which will prevent a ball from both falling over the carpet edge and rebounding back onto the playing green.

One golf putting device that utilizes a restraining means that is not merely a backstop is disclosed in the U.S. Pat. No. 4,634,130 of Simjian. However this device is quite large and bulky, and presumably expensive, and would be difficult to move between storage and use locations. Examples of golf targets that will retain a golf ball when the target has been struck are disclosed in the U.S. Pat. No. 4,691,922 of Peel et al and the U.S. Pat. No. 3,458,202 of McNamara. While these devices may be good for their intended use, they clearly are not designed for use in doors or for attachment to an existing putting carpet.

SUMMARY OF THE INVENTION

The present invention provides an inexpensive, extremely versatile golf ball retainer that is easily removeable and attachable to a commercially available golf putting carpet. Such a device also has the advantages and features that it is extremely light weight, durable, inexpensively manufactured, yet highly effective. It can be purchased either with a golf carpet or obtained separately and attached to a golf putting carpet. In addition, it can have any shape that the carpet has, including linear or curvilinear.

A device according to the present invention also provides a more realistic setting for the golfer than a mere backstop. A backstop, contrary to the real thing at a golf course, provides the possibility of a ricochet shot dropping into the cup. Rather, the present invention provides a device which will not only stop a golf ball from rolling off the edge of the practice putting carpet so that it can be easily retrieved, but will also retain the golf ball off the putting surface so that it cannot unrealistically reenter the playing field.

In one embodiment of the invention, the present invention comprises a means for removably grasping a portion of the edge of a putting material and a catcher means rigidly mounted to the grasping means for retainably receiving a ball rolling into contact therewith.

The foregoing and other features, advantages and elements of the present invention will be set forth in or apparent from the following detailed description of the invention when taken in conjunction with the accompanying drawings.

DETAILED DESCRIPTION OF THE PREFERRED EMBODIMENT

Figure 1:
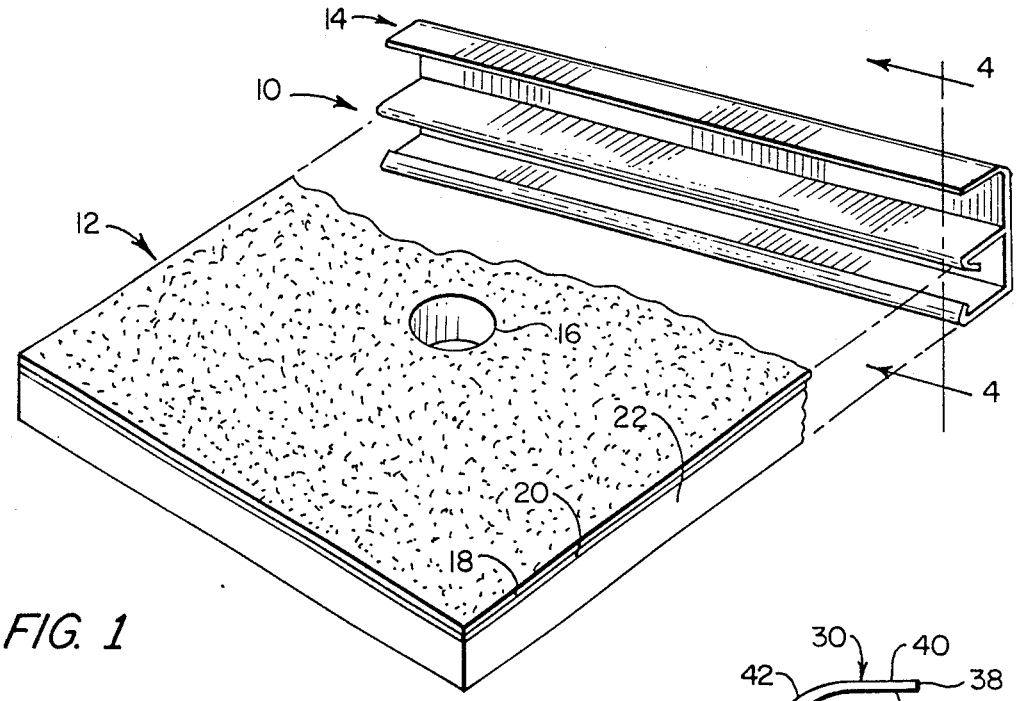
FIG. 1 is a perspective view, with parts removed, of a golf putting device according to the present invention.

With reference now to the figures wherein like numerals represent like elements throughout the several views, a golf practice putting device 10 is depicted in FIG. 1. Putting device 10 comprises a putting carpet 12 and a ball retainer 14 removeably mounted at one end of carpet 12. Putting carpet 12 is generally conventional and is commercially available. In the particular embodiment depicted in FIG. 1, putting carpet 12 has an overall rectangular shape in plan view with a commercial length of about nine feet and a width of about eighteen inches.

Putting carpet 12 is provided with an orifice 16 which serves as a golf cup and a target at which a golf ball is stroked. Orifice 16 extends completely through carpet 12, thereby utilizing the floor as the bottom of the golf cup. It is noted that orifice 16 is depicted closely spaced to the end of carpet 12 to which ball retainer 14 is attached.

In one commercial embodiment, putting carpet 12 is comprised of three layers of material: an upper, grassy layer 18; a resilient middle, backing layer 20; and a thick bottom layer 22 that only extends part of the length of carpet 12 and is preferably made of a sponge rubber type of material.

Grassy layer 18 simulates the short cropped grass of the golf green. Grassy layer 18 is common on many indoor/outdoor type carpets as well as athletic playing fields where it is commonly called artificial turf. Grassy layer 18 is approximately an eighth of an inch thick and is mounted on backing layer 20, which is also about ⅛ of an inch thick.

Backing layer 20 is a commercially available sponge rubber type layer on which grassy layer 18 is affixed. Both grassy layer 18 and backing layer 20 have the same thickness throughout the nine foot length of putting carpet 12.

Bottom layer 22, however, has an overall wedge-shape in longitudinal cross section and has a length of only 2½ feet. Thus, bottom layer 22 exists only at the orifice 16 end of carpet 12. At the near end of carpet 12, bottom layer 22 has a thickness of approximately 1⅛ of a inch and tapers from there to a minimum thickness of about ⅛ of an inch at the far end of bottom layer 22.

Thus, it can be seen, that carpet 12 simulates, in miniature, the overall golf green where orifice 16 at the near end of carpet 12 is analogous to the cup area of a golf green having an upward slope, the far end of carpet 12 is analogous to the rough, and the intermediate area of carpet 12 up to the beginning of bottom layer 22 represents the main green area. Bottom layer 22 is preferably made of a sponge rubber material and provides the golfer with a little challenge by presenting a slightly sloping green area. This obstacle not only increases the difficulty of play, but also improves the probability of the golfer missing the cup located at orifice 16. It is for these missed shots that the present invention includes ball retainer 14.

Ball retainer 14 will be described with particular reference to the scale drawing in FIG. 2. Ball retainer 14 is made of a rigid plastic material such as polyvinylchloride (PVC), can be injection molded or extruded in one integral piece. In the preferred embodiment, the plastic material is 50 mils thick (0.060 inches) at all locations.

Ball retainer 14 is comprised of two major sections, a U-shaped or channel shaped catcher section 24 to catch a golf ball and a similarly U-shaped or channel shaped grasping section 26 to removably grasp the circumferential edge of putting carpet 12. Ball retainer 14 has a substantially E-shaped cross section with a back 28 and a top arm 30, a middle arm 32 and a bottom arm 34, all integral with back 28 so as to form a single, unitary element.

For the purpose of convention, the present application describes the relative directions of top and bottom, front and back, and near and far with respect to ball retainer 14 as it is installed on putting carpet 12 as depicted in FIG. 1.

Figure 4:
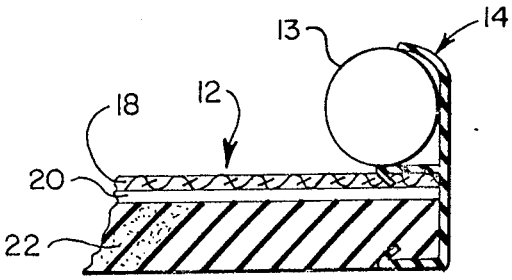
FIG. 4 is a sectional view taken along line 4—4 in FIG. 1, but showing a deflection of the catcher means by a retained golf ball.
Figure 2:
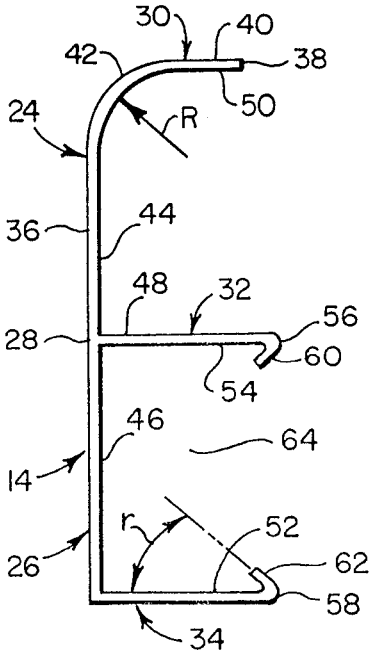
FIG. 2 is an end elevational scale view, in full scale, of a presently preferred embodiment of the present invention.
Figure 3:
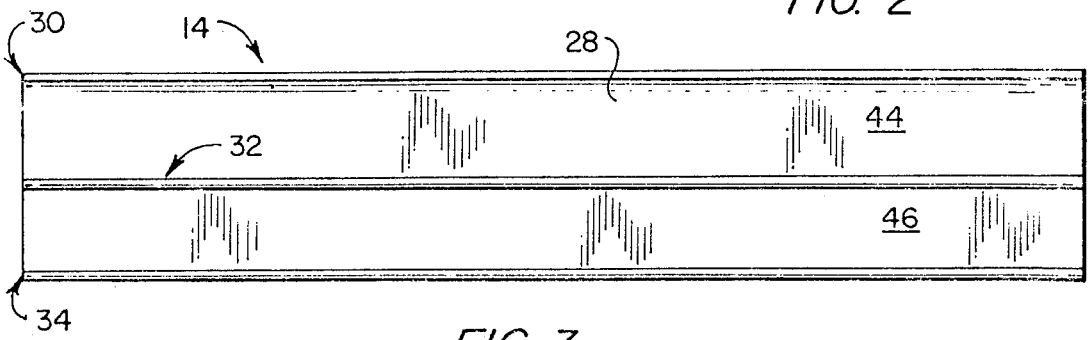
FIG. 3 is a front elevational view.

As can be readily seen in FIG. 2, top arm 30 is the shortest of the three arms, and in the preferred embodiment is only one inch long from the back surface 36 of back 28 to the tip 38 of arm 30. On the other hand, middle arm 32 and bottom arm 34 each have a similar length of 1.25 inches, which can be compared with the overall height of 3.519 inches of ball retainer 14. Top arm 30 is the shortest of the three arms because it must remain the most flexible so that it can grasp a golf ball, on the one hand, yet not provide a large enough force moment or lever action so as to uncouple the engagement of ball retainer 14 with putting carpet 12. As also can be seen in FIG. 2, top arm 30 is comprised of a straight or horizontal portion 40 and a curved or arcuate (in cross section) portion 42. Arcuate portion 42 has a radius of curvature R of ½ inch. This radius of curvature has been found to provide the requisite flexibility of horizontal portion 40, on the one hand, while on the other hand still providing sufficient resiliency to hold a golf ball B that falls within its grasp, as shown in FIG. 4.

Back 28 of ball retainer 14 has an upper section 44 and a lower section 46. The overall height of upper section 44 from the top surface 48 of middle arm 32 to the bottom surface 50 of upper arm 30 should be slightly less than the diameter of a golf ball, and in the present embodiment is 1.654 inches.

On the other hand, lower section 46 of back 28 has an overall height from the top surface 52 of bottom arm 34 to the bottom surface 54 of middle arm 32 that is determined by the overall thickness of putting carpet 12 at the orifice 16 end thereof. In the present embodiment, the overall thickness of putting carpet 12 at the end where orifice 16 is located is 1 9/16 of an inch, whereas the height of lower section 46 is 1 10/16 of an inch, or slightly more. This permits the easy insertion of the end of putting carpet 12 between middle arm 32 and bottom arm 34.

In addition to middle arm 32, bottom arm 34 and lower back section 46, grasping section 26 also comprises means for engaging both top and bottom surfaces of putting carpet 12. In the present embodiment, the engaging means comprises a hook 56 integral with the free end of middle arm 32 and a hook 58 integral with the free end of bottom arm 34. Both hooks 56 and 58 have a radius of curvature of 0.070 inches and include a tip portion 60 and 62, respectively, that extends inwardly toward the opposite arm (34 or 32, respectively) such that together with its corresponding arm (32 and 34, respectively) there is formed a substantially J-shaped cross section. In other words, hooks 56 and 60 comprise an integral bent portion that extends into a channel space 64 formed by arms 34 and 36 and back lower section 46. In the embodiment depicted in FIG. 2, the distance between the ends of tips 60 and 62 is 1.350 inches. It has been found that with this spacing apart of tips 60 and 62 and with an angle of "r" equals 36 degrees between each tip portion 60 and 62 and arms 32 and 34, respectively, a sufficiently secure grasp of an inserted end of carpet 12 is achieved.

In use, a carpet 12 is first unrolled to lie flat on the ground or floor of a room. The grasping section 26 of a retainer 14 is then easily inserted over the near end of carpet 12 and putting device 10 is ready to be used. When the golfer unsuccessfully attempts to hit a golf ball B the length of carpet 12 toward orifice 16 and misses, ball B may remain on the playing area near orifice 16. However, if ball B were hit too hard, it will strike tip 38 of top arm 30 of the catcher section 24 and deflect it upwards as depicted in FIG. 4. The resiliency of top arm horizontal portion 40 will retain ball B within catcher section 24 and prevent it from either falling off the end of carpet 12 or rebounding back onto the playing field and possibly into orifice 16.

The present invention has been described with respect to a presently preferred embodiment with presently preferred dimensions. However, it should be appreciated by those in the art that the particular configurations and dimensions may be modified without departing from the scope of the present invention, which scope is measured by the claims appended hereto. Other modifications and changes can also be made to the presently preferred embodiments. For example, the shape of carpet 12 could be round or doglegged and ball retainer could be attached to the sides as well as the ends. In addition, other grasping means, such as VELCRO type materials, could be utilized. Still other modifications and changes would be obvious to those in the art.

I claim:

1. For use with a putting material having a predetermined thickness, a top surface, a bottom surface, and a circumferential edge, a ball retainer comprised of means for removably grasping a portion of the material edge; and catcher means rigidly mounted to said grasping means for retainably receiving a ball having a predetermined diameter coming into contact therewith, said catcher means comprising an elongate channel member having a substantially U-shaped cross section and including a flexible upper arm, a lower arm which, when said ball retainer is installed on the material, contacts the top surface thereof, and a back connecting said upper and lower arms in a spaced apart relationship, said upper and lower arms each having a connected side attached to said back and a free side, said free sides of said upper and lower arms being spaced apart a distance that is slightly less than the ball diameter and having a resiliency therebetween such that the ball can become engaged therebetween.

2. A ball retainer as claimed in claim 1 wherein said grasping means comprises a further elongate channel member having a substantially U-shaped cross section and including an upper arm which, when said catcher means is installed on the material, contacts the top surface thereof, a lower arm which, when ball retainer is installed on the material, contacts the bottom surface thereof, and a back connecting said upper and lower arms in a spaced apart relationship, said upper and lower arms each having a connected side attached to said back and a free side, said free sides of said upper and lower arms being spaced apart a distance that is about the thickness of the material.

3. A ball retainer as claimed in claim 2 wherein said grasping means upper arm is integral with said catcher means lower arm.

4. A ball retainer as claimed in claim 2 wherein said grasping means and said catcher means together have a substantially E-shaped cross section.

5. A ball retainer as claimed in claim 2 wherein said grasping means further includes hook means mounted at said free side of at least one of said upper and lower grasping means arms, said hook means for engaging a surface of the putting material when said ball retainer is installed on the material.

6. A ball retainer as claimed in claim 5 wherein said hook means comprises an integral bent portion of said one grasping means arm that extends inwardly toward said other grasping means arm such that said one grasping means arm and hook means has a substantially J-shaped cross section.

7. A ball retainer as claimed in claim 6 wherein said grasping means bent portion extends the entire length of said grasping means arm.

8. A ball retainer as claimed in claim 2 wherein said catcher means upper arm free end extends a smaller distance from said back than said catcher means lower arm free end and said free ends of said grasping means arms.

9. A ball retainer as claimed in claim 6 wherein said grasping means comprises a hook means on each of said upper and lower grasping means arms and each said hook means comprises an integral bent portion of the corresponding said grasping means arm that extends the entire length thereof and extends inwardly toward said other grasping means arm such that said corresponding grasping means arm and hook means has a substantially J-shaped cross section.

10. A ball retainer as claimed in claim 9 wherein said grasping means upper arm is integral with said catcher means lower arm; and wherein said grasping means and said catcher means have a substantially E-shaped cross section.

11. A ball retainer as claimed in claim 10 wherein said ball retainer is molded as one integral piece.

12. A ball retainer as claimed in claim 11 wherein said ball retainer is molded from a plastic material so that all of said arms and said backs are resiliently flexible and have substantially the same cross sectional thickness.

13. A ball retainer as claimed in claim 10 wherein said ball retainer is molded as one integral piece from a plastic material so that said arms and said back are resiliently flexible and have substantially the same cross sectional thickness.

14. A golf practice putting device that includes a putting material having a predetermined thickness, a top surface, a bottom surface, and a circumferential edge, and having means indicating the location of the golf hole therein, the improvement comprising a ball retainer mounted on the circumference of said material to catch a golf ball that misses the golf hole, said ball retainer comprised of means for grasping a portion of the material edge; and catcher means rigidly mounted to said grasping means for retainably receiving a ball having a predetermined diameter coming into contact therewith, said catcher means comprising an elongate channel member having a substantially U-shaped cross section and including a flexible upper arm, a lower arm which contacts the top surface of said material, and a back connecting said upper and lower arms in a spaced apart relationship, said upper and lower arms each having a connected side attached to said back and a free side, said free sides of said upper and lower arms being spaced apart a distance that is slightly less than the diameter of the golf ball and having a resiliency therebetween such that the golf ball can become engaged therebetween.

15. A ball retainer as claimed in claim 14 wherein said grasping means comprises a further elongate channel member having a substantially U-shaped cross section and including an upper arm which, when said catcher means is installed on the material, contacts the top surface thereof, and a lower arm which, when ball retainer is installed on the material, contacts the bottom surface thereof, and a back connecting said upper and lower arms in a spaced apart relationship, said upper and lower arms each having a connected side attached to said back and a free side, said free sides of said upper and lower arms being spaced apart a distance that is about the thickness of the material; and wherein said grasping means and said catcher means together have a substantially E-shaped cross section.

16. A ball retainer as claimed in claim 15 wherein said ball retainer is molded as one integral piece.

17. A ball retainer as claimed in claim 15 wherein said grasping means comprises hook means mounted at said free side of each of said upper and lower grasping means arms, said hook means for engaging a corresponding surface of the putting material and comprises an integral bent portion of the corresponding said grasping means arm that extends the entire length thereof and extends inwardly toward said other grasping means arm such that said corresponding grasping means arm and hook means has a substantially J-shaped cross section.

18. For use with a putting material having a predetermined thickness, a top surface, a bottom surface, and a circumferential edge, a ball retainer comprised of means for removably grasping a portion of the material edge, said grasping means comprising an elongate channel member having a substantially U-shaped cross section and including an upper arm which, when said catcher means is installed on the material, contacts the top surface thereof, and a lower arm which, when ball retainer is installed on the material, contacts the bottom surface thereof, and a back connecting said upper and lower arms in a spaced apart relationship and defining therewith an interior channel space, said upper and lower arms each having a connected side attached to said back and a free side, said free sides of said upper and lower arms being spaced apart a distance that is about the thickness of the material, and engaging means mounted on said channel member for removably engaging at least one surface of the putting material; and preventing means rigidly mounted to said grasping means for preventing a ball from falling over the edge of the material.

19. A ball retainer as claimed in claim 18 wherein said engaging means comprises hook means mounted at said free side of at least one of said upper and lower grasping means arms, said hook means for engaging a surface of the putting material when said ball retainer is installed on the material.

20. A ball retainer as claimed in claim 19 wherein said engaging means includes a hook means on each of said upper and lower grasping means arms and each said hook means comprises an integral bent portion of said one grasping means arm that extends into said channel space such that said one grasping means arm and hook means has a substantially J-shaped cross section.

* * * * *